US007947932B2

(12) United States Patent
Sherrill et al.

(10) Patent No.: US 7,947,932 B2
(45) Date of Patent: May 24, 2011

(54) OPEN COIL ELECTRIC RESISTANCE HEATER WITH OFFSET COIL SUPPORT AND METHOD OF USE

(75) Inventors: James L. Sherrill, Cookeville, TN (US); R. Devin Ridley, Cookeville, TN (US)

(73) Assignee: Tutco, Inc., Cookeville, TN (US)

( * ) Notice: Subject to any disclaimer, the term of this patent is extended or adjusted under 35 U.S.C. 154(b) by 626 days.

(21) Appl. No.: 11/987,542

(22) Filed: Nov. 30, 2007

(65) Prior Publication Data

US 2009/0139984 A1 Jun. 4, 2009

(51) Int. Cl.
*H05B 3/06* (2006.01)
*H01C 3/14* (2006.01)

(52) U.S. Cl. ..... 219/532; 219/536; 219/537; 219/535; 219/541; 219/552; 219/476; 219/477; 219/478; 338/304; 338/305; 338/319; 338/320; 338/299

(58) Field of Classification Search ..... 219/532, 219/536, 537, 535, 541, 552, 477, 478, 476; 338/304–5, 319–20, 299
See application file for complete search history.

(56) References Cited

U.S. PATENT DOCUMENTS

| | | | | |
|---|---|---|---|---|
| 4,268,742 | A | 5/1981 | Cottrell et al. | |
| 5,329,098 | A | 7/1994 | Howard et al. | |
| 5,895,597 | A | 4/1999 | Sherrill | |
| 5,925,273 | A * | 7/1999 | Sherrill | 219/478 |
| 7,075,043 | B2 | 7/2006 | Howard et al. | |
| 7,154,072 | B2 | 12/2006 | Sherrill et al. | |

* cited by examiner

*Primary Examiner* — Shawntina Fuqua
(74) *Attorney, Agent, or Firm* — Clark & Brody

(57) ABSTRACT

An open coil electrical resistance heater uses a number of offset insulators to support the coil of the heater. The offset insulators configure the run of coil in a sinusoidal shape to hold the insulators in a more secure manner and reduce vibration and noise generation during heat operation. The sinusoidal configuration of the coil also reduces the problem of shadowing of portions of the resistance wire coil.

13 Claims, 4 Drawing Sheets

OPEN COIL ELECTRIC RESISTANCE HEATER WITH OFFSET COIL SUPPORT AND METHOD OF USE

FIELD OF THE INVENTION

The present invention is directed to an open coil electric resistance heater and method for use, and in particular to a heater configuration that uses offset insulators to support the open coils for improved heater performance.

BACKGROUND ART

The use of a single resistance wire formed into a helical coil for use in electric resistance heating either for heating moving air, for radiant heating or for convection heating is well known in the prior art. In one type of heater, the resistance coils are energized to heat air passing over the coils, the heated air then being directed in a particular manner for heating purposes. One application using such a heater is an electric clothes dryer.

Examples of open coil heaters are found in U.S. Pat. Nos. 5,329,098, 5,895,597, 5,925,273, 7,075,043, and 7,154,072, all owned by Tutco, Inc. of Cookeville, Tenn. Each of these patents is incorporated by reference in its entirety herein. One type of an open coil electric resistance heater is a two stage heater described in U.S. Pat. No. 7,075,043. A side view of this type of heater is shown in FIG. 1 and designated by the reference numeral 10. The heater 10 has two heater elements 10*a* and 10*b*, optimally for use in a clothes dryer. The elements 10*a* and 10*b* are supplied with electricity via terminals 12 extending from the terminal block 28. The heater elements 10*a*, 10*b* are supported by a metal plate 14, which in turn supports a plurality of support insulators 16, typically made of ceramic material and which are well known in the art. The support insulators 16 support and isolate coiled portions of the elements, 10*a* and 10*b*, during operation of the heater.

The heater 10 includes opposing sidewalls (one shown as 6 in FIG. 1), wherein projections in the plate 14 extend through slots 20 in the sidewall 6 to allow the sidewalls to support the plate.

Each of the electric heater elements, 10*a* and 10*b*, is arranged in series of electrically continuous coils which are mounted on the plate 14 in a spaced-apart substantially parallel arrangement. Each heater assembly 10*a* and 10*b* is arranged substantially equally and oppositely on both sides of the plate. Crossover portions 22*a* and 22*b* of each heater element 10*a* and 10*b* are provided wherein each crossover links one coil of each of the elements mounted on one side of the plate 14 with another coil of the same element found on the other side of the plate.

Electricity is supplied to the heater assembly through the terminal block 28. The heater elements, 10*a* and 10*b*, are arranged so that the terminal connector portions or wire leads 32 and 34 which extend from an end 38 of each of the mounted coil sections to the terminal block are as short as possible. This aids in eliminating or reducing the need for supporting the connector portions. For the longer runs, the wire leads, 32 and 34, are partially enclosed with an insulating member 36. The insulating member 36 may be formed from any type of insulating material suitable for this purpose, e.g., a ceramic type. The insulating member is generally tubular in shape and rigid.

FIG. 2 shows a typical plate 14 that supports the insulators 16. The plate 14 has a pair of cutouts 24 and 26, wherein cutout 24 accommodates the crossover portion of the heating element and allows for installation of a standoff for support of the heating element, with cutout 26 allowing for a standoff mounting. Cutout 28 accommodates the mounting of the terminal blocks.

The plate 14 also has a series of cutouts 30, which allow for mounting of the insulators 16. The cutouts 30 are elongated in shape to allow for insertion of the insulators in a first orientation and then twisting of the insulators for engagement with the plate for secure mounting. It should also be noticed that the cutouts are generally aligned in a longitudinal path along the plate 14. The resistance wire coil is supported along the path, designated as A in FIG. 2, by the insulators mounted in the cutouts 30. The path A also defines the flow path of the air passing over the open coil. The insulators are designed with some combination of notches or with notches and arms or protrusions to mate with the cutouts 30 in the plate 14 holes and may be retained by tabs in the plate 14. The mounting of these insulators is well known and a further description is not deemed necessary for understanding of the invention. The plate 14 is affixed to the ductwork in such a fashion as to assure airflow over the heater coils, maintain required electrical spacing and provide for the routing of electrical power. The actual cross-section of the ductwork depends upon requirements of the particular application. While FIG. 1 is representative of a heater using a rectangular cross section for air flow, the ductwork can be circular or another cross sectional shape as well.

The manufacturing of appliances and equipment, especially clothes dryer manufacturing, often requires that open coil electric resistance heaters be mounted in a heater duct. As the clothes dryer operates, the temperature experienced by the heater in a duct will increase and decrease over several hundreds of degrees. It is natural for the materials of which the heater and duct are made to undergo expansion and contraction during the thermal cycling of the dryer. Generally the metal plates supporting the coil, e.g., the plate 14 of FIGS. 1 and 2, will undergo some degree of oxidation with time.

The prior art heaters made with heater coils supported by insulators as illustrated above are designed so as to accommodate differences in the thermal expansion rate of the metal plate as compared to the thermal expansion of the insulators which support the heater coils plus accommodate any build up of oxide on the metal plate. The method used in the prior art is to create the holes and tabs, i.e., the cutouts, in the metal plate and design the slots and arms of the insulators so there will be sufficient clearance to accommodate expansion, contraction and metal oxide buildup on the metal plate. Expansion, contraction and metal oxidation build-up can then occur without damage to either the insulator or to the metal plate. If such accommodations are not made, there may be conditions develop in which the insulators can actually break or the metal plate can crack or both conditions may occur.

A consequence of the necessary clearance between the cutouts in the metal plate and the mating slots in the insulators means that under certain conditions of operation vibration of the equipment may occur and the heater itself will vibrate which in turn results in the insulators vibrating against the metal plate. This means the necessary looseness of the insulators in the metal plate may create noise during operation. If the noise is high enough, the user of the equipment, e.g., the user of a clothes dryer in a home, may determine the noise level is objectionable. The objectionable noise level is considered a problem with the prior art.

Another problem with open coil electrical resistance heaters is the configuration of the open coil resistance wire heating element. That is, heaters are often designed with the heater coils configured so as to be made up of a number of straight sections, the axis of each section running parallel to the axis of the air duct. This is best seen when referring to FIG. 2, wherein the axis of the open coil would be parallel to the path of air travel. Other configurations, such as "figure 8" arrangements (see U.S. Pat. No. 4,268,742) or short straight sections running perpendicular to the air flow, which is depicted in FIG. 1 (see U.S. Pat. No. 5,329,098) also exists. As air is either drawn or forced through the duct to be heated by the heating element, downstream heater coil convolutions in any given straight section are shadowed by upstream heater coil convolutions from that same given straight coil section. This means the heater coil being shadowed operates at temperatures higher than when compared to a no shadowing condition. Coil shadowing is considered to be undesirable. Heaters with a "figure 8" coil arrangement will partially address the coil shadowing. If attempts are made to design the straight coil sections at an angle to the axis of the duct, it is necessary to reduce the spacing between coil passes, which is undesirable.

As with all open coil heaters, for a heater made with heater coils supported by insulators, which are in turn supported by a metal plate, it is desirable to have the heater coils arranged so that as much of the duct cross section as possible is filled or covered by heating element material so as to maximize heat transfer to the air stream. The straight coil pass method is not always the best for this because of the shadowing problem. The "figure 8" method of arranging the heater coil is one method used to increase the portion of the duct covered by heater coil. When the length of heater coil is sufficiently long or for multiple coils, as in multi-stage heaters, the "figure 8" arrangement is not a suitable choice as additional space to accommodate the arrangement may not be available.

Therefore, a need has developed to provide improved open coil electrical resistance heaters. The present invention responds to this need with an improved heater configuration that overcomes the problems noted above, especially minimizing noise due to vibration of insulators during heater operation, minimizing shadowing, and increasing the exposure of the coil to the air to be heated.

SUMMARY OF THE INVENTION

It is a first object of the invention to provide an improved open coil electrical resistance heater.

It is another object of the invention to provide an open coil electrical resistance heater that uses specially configured insulators to configure the open coil resistance wire heating element in a sinusoidal shape.

Another object of the invention is a method of heating air using an open coil electrical resistance heater having the specially configured insulators and resistance wire heating element.

Other objects and advantages will become apparent as a description of the invention proceeds.

In satisfaction of the foregoing objects and advantages of the invention, the invention is an improvement in open coil electrical resistance heaters that have a support, at least one resistance wire coil, and a plurality of insulators mounted to the support along a defined path, with each insulator configured to provide support to a portion of the resistance wire coil. The at least one resistance wire coil has a longitudinal axis generally parallel to an air flow path of the heater. According to the invention, at least a portion of the insulators are offset from the path. These offset insulators when combined with the insulators on the path cause at least a portion of the at least one resistance wire coil to have a sinusoidal shape. It is this sinusoidal shape that provides advantages in terms of noise reduction, reduction of the shadowing problem, minimizing vibration resonancy, and better filling the volume of the heater for maximized heat transfer.

While the support for the insulators can take on any number of configurations, a preferred configuration is a metal plate. Using a metal plate allows for the use of cutouts in the metal plate to mount the insulators therein. Offsetting the cutouts positions the insulators in the offset position to create the sinusoidal shaped resistance wire coil.

While the heater can be as simple as one resistance wire coil and the necessary components for energizing it, the support or metal plate can be configured to retain a number of resistance wire coils for increased heating capability. In this mode, the insulators can be configured to hold segments of a coil on each end, such that coils would travel along both sides of the support or metal plate.

The duct for use with the support, insulators, and resistance wire coils can be of any cross sectional shape, with a circular duct being one preference.

The sinusoidal shape of the resistance wire coil aids in vibration prevention by biasing sides of the insulators against sides of the cutouts.

The invention also entails the use of the improved heater assembly described above by passing air over the at least one resistance wire coil in a direction coincident with the longitudinal axis of the coil and energizing the heater for heating of the air passing therethrough.

BRIEF DESCRIPTION OF THE DRAWINGS

Reference is now made to the drawings of the invention wherein.

DESCRIPTION OF THE PREFERRED EMBODIMENTS

The invention offers advantages in the field of open coil resistance heaters in that the problems in noise generation and premature failure of heater components are minimized. In addition, the inventive open coil electrical resistance heater is advantageous in reducing the amount of shadowing that occurs in prior art heaters and promoting a longer life operation of the heater. The invention is particularly adapted for heaters that employ resistance wire coils that are aligned with the flow of air through the heater. It is these coils that are susceptible to the problem of shadowing and the offsetting of the insulators to create the sinusoidal shape in the coil minimizes this problem. The offsetting that creates the sinusoidal coil configuration also contributes to filling the volume of the heater that air passes through for better heating efficiency.

Features of the invention also include the following:

1) An open coil electric heater for heating moving air with the heating element made up of sections of coils such that one end of a given coil section is located on the inlet air portion and the other end is at the exit air portion.

2) Insulators engage sufficient numbers of convolutions at points along each coil section supporting the coil thereby holding the heater coils section in place as each insulator is retained by a metal plate.

3) The insulators are retained in the metal plate by cutouts in the metal plate engaging slots and possibly arms in the insulators.

4) Each cutout in the metal plate is designed so as to engage the corresponding slots and possibly arms in the insulators retained yet allow for expansion and contraction resulting from the heating and cooling of the heater.

5) The insulators supporting a given coil section are arranged so as to create a sinuous path for the coil section. The sinuous coil path thereby creates sufficient tension so as to dampen vibration of the insulators against the metal plate.

6) The sinuous coil passes effectively expose a greater portion of each coil pass to the moving air stream for greater transfer of heat to the moving air stream being heated.

7) The sinuous coil passes effectively reduce the "shadowing" relative to a straight coil section arranged parallel to the air flow direction.

Referring now to FIGS. 3-7, one embodiment of a partial assembly of open coil electrical resistance heater is illustrated. The embodiment depicts components of a heater assembly critical to the invention, but omits those components that are well known, e.g., terminals and terminal blocks, means for fastening the plate to the duct, the necessary lead wiring to connect lead ends of the resistance wire coils to a source of power for energizing the heater, etc.

Figure 4:
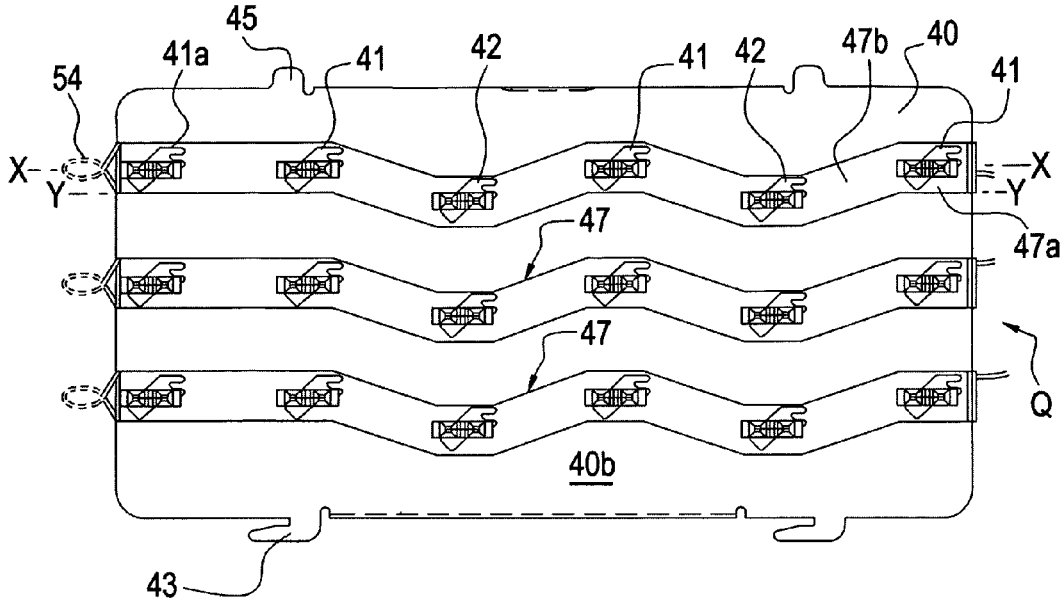
FIG. 4 is a schematic plan view of the plate of FIG. 3 with insulators and an open coil resistance wire heating elements mounted to the insulators.

FIG. 4 depicts a plate 40, with surface 40*a*, which is especially configured to orient the insulators and a resistance wire coil in the inventive configuration. The plate 40 includes a number of cutouts 41 and 42. The cutouts 41 are shown on path X with the cutouts 42 aligned with path Y. The cutouts 42 on path Y are offset from the cutouts 41 on path X to provide improved performance in terms of noise reduction, reducing the shadowing effect, and other advantages as explained in more detail below.

The plate 40 also includes tabs 43 and 45, which interface with a duct for attachment thereto. The other features of the plate are conventional and do not require further explanation for understanding of the invention.

Referring now to FIGS. 4-7, the plate 40 and its other side 40*b*, is shown in combination with resistance wire formed schematically into coils 47 and insulators 49. The insulators 49 are configured with tabs 51, formed to create spaces 53 to receive segments 55 of the resistance wire forming the coil 47 to hold the coil in place. The insulators also have slots 57 sized to receive a portion of the plate and arms 59 intended to abut a plate surface when the insulators are mounted in the cutouts. The cutouts as well as the slots and arms should be configured so that the insulator is held in place while allowing the metal plate to expand and contract as a result of the heater operation.

FIG. 4 best shows one effect of the offset created by the cutouts 41 and 42 and insulators 49 mounted therein when the configured coils 47 are aligned with a path of the air passing through the heater. By offsetting the cutouts 41 and 42, the coils 47 takes on a sinusoidal shape at least along a portion of their length. In this embodiment, only a portion of the cutouts are offset from each other, with the cutout 41*a* at the end of the plate 40 where the wire crossover 54 occurs, lying on the same path X. In this embodiment, the cutout 41*a* is not offset from its adjacent cutout so that the coils are centralized for the crossover.

The invention is ideally adapted for a heater that has the path of air aligned with the longitudinal orientation of the coils 47. This path of air is shown in FIG. 4 as path Q. By offsetting the cutouts and mounted insulators such that the coils 47 follows a sinusoidal or at least partially sinusoidal path overcomes three of the prior art problems noted above. First, by arranging the insulators 49 of a given coil section in an offset fashion, tension forces resulting from the coil seats each insulator against a side of the cutout, see side 44 in FIG. 3 as an example. This has the effect of dampening the vibration of the insulator against the metal plate 40, thus reducing the vibration or "rattling" of the heater coil support insulator 49 against the plate 40 thereby reducing noise, which is desirable.

Second, by arranging the insulators 49 supporting a given coil section in an offset fashion, the resultant sinuous pattern of the heating coil reduces the tendency for vibration resonance to occur as compared to a straight coil pattern.

Figure 1:
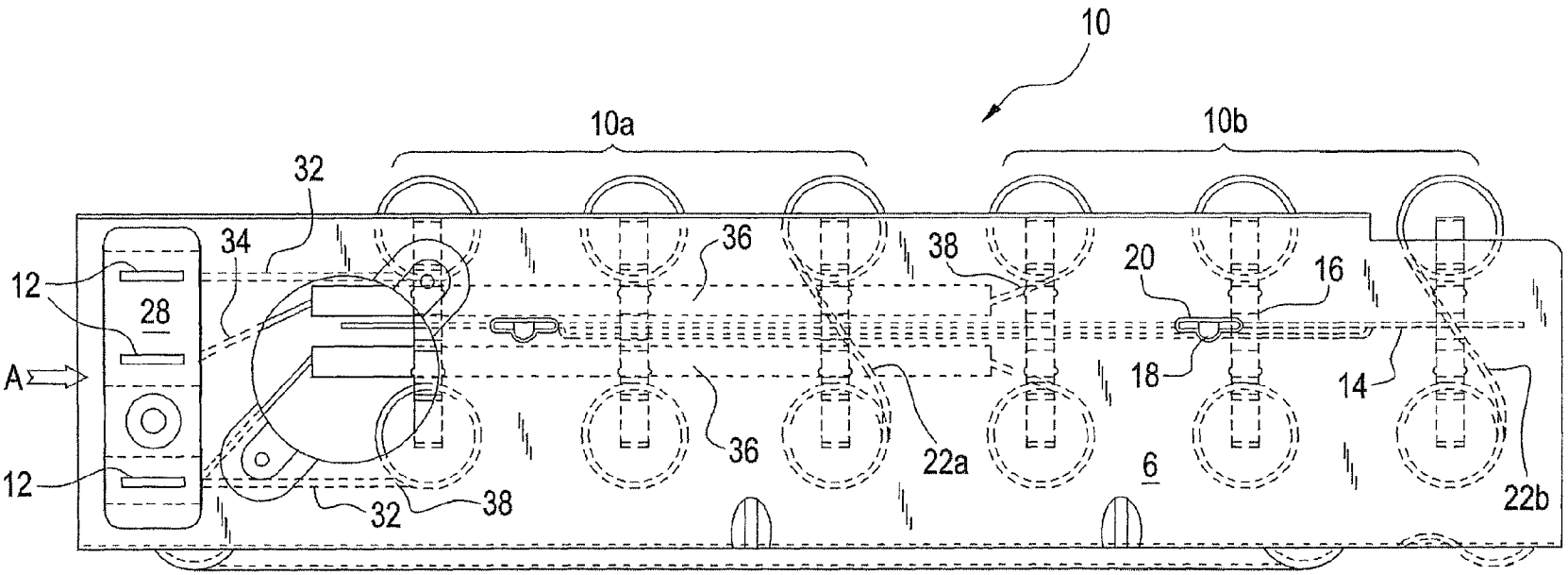
FIG. 1 PRIOR ART
FIG. 1 is a side view of a prior art open coil electric resistance heater.
Figure 2:
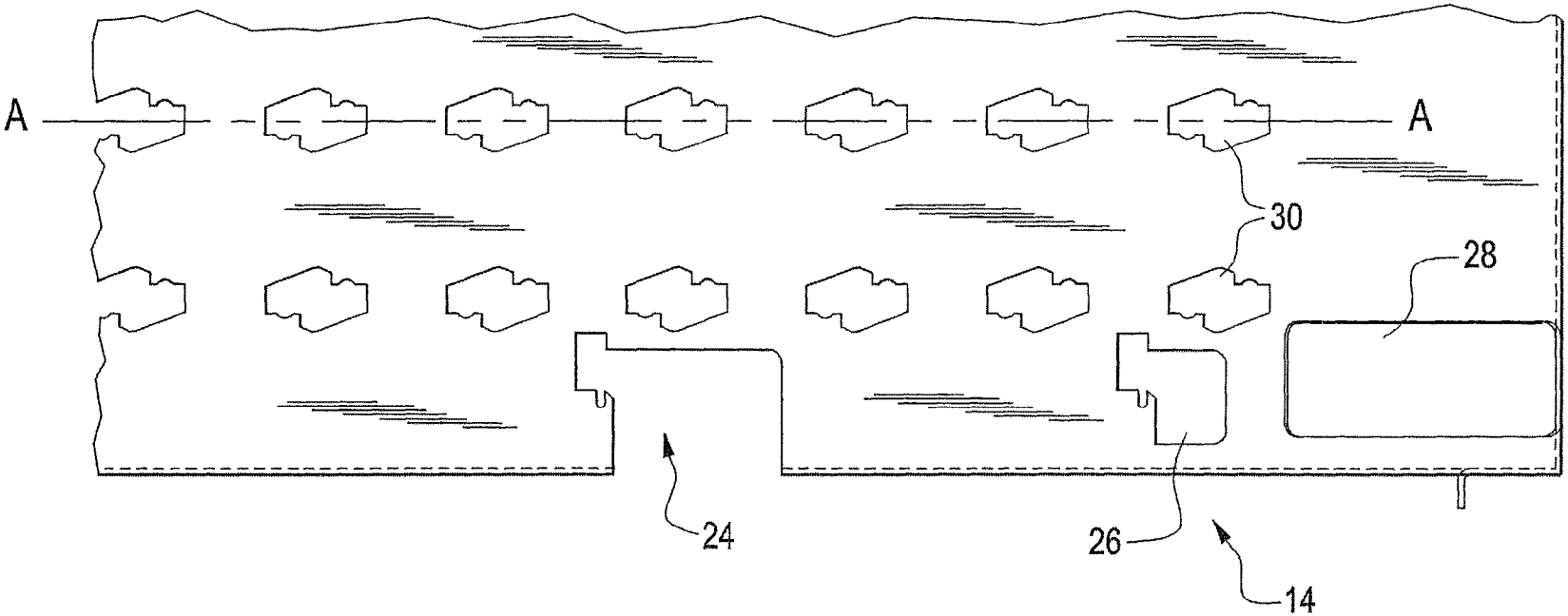
FIG. 2 PRIOR ART
FIG. 2 is a plan view of the prior art metal plate used for supporting insulators of the heater of FIG. 1.
Figure 3:
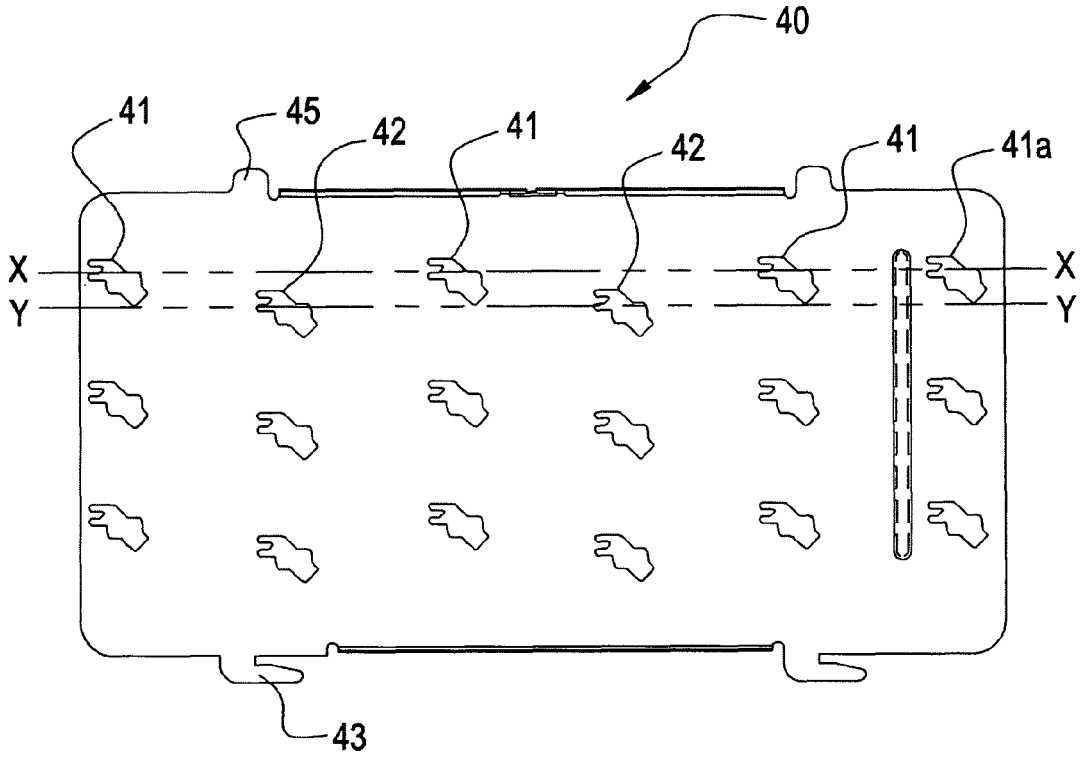
FIG. 3 is top view of a plate used in a heater according to a first embodiment of the invention.
Figure 6:
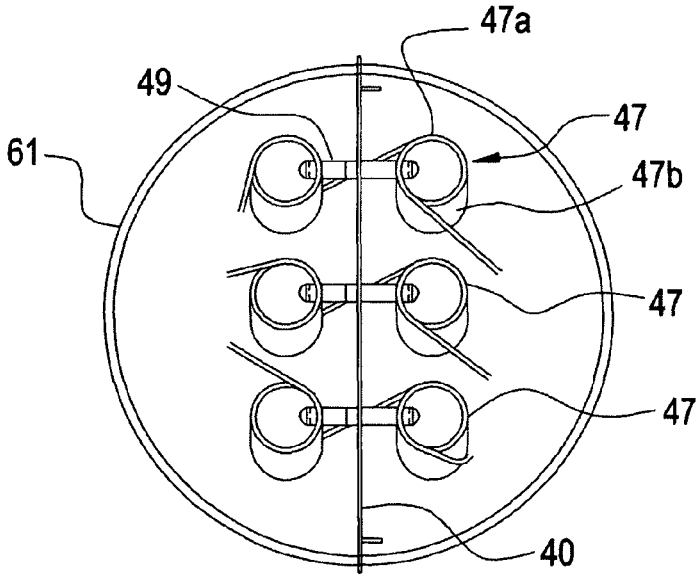
FIG. 6 is an end view of the assembly of FIG. 4.

Third, by arranging certain of the insulators of a given coil in an offset fashion, shadowing of downstream heater coil convolutions in any given straight section by upstream heater coil convolutions from that same given straight coil section is reduced. Shadowing results when air heated by an upstream helix flows over and heats down stream helixes. By reducing shadowing, the operating temperature of the heater coil is reduced which is desirable. This is best seen in FIGS. 4 and 6. Here, the coil 47 is identified by coil segments 47*a* and 47*b* that make up part of the sinusoidal shape. By offsetting the support of the coil using the cutout 42 and insulator 49, the coil segment 47*b* is exposed. This exposure means that the air entering the heater along path Q contacts the coil 47. The air strikes not only the initial coil segment 47*a* but also the coil segment 47*b*, created by the offset insulator 49. Since the coil segment 47*b* is exposed to the air traveling on path Q, coil segment 47*b* is not subjected to the increased heating that would occur if the coil 47 had a straight alignment and the portion of the coil downstream of initial coil segment 47*a* is contacted by hot air already heated by coil segment 47*a*.

FIG. 6 also shows the plate 40 in combination with a circular duct 61. The circular duct is one option, but other duct cross sectional configurations could be employed, oval, rectangular, square, and the like.

Fourth, by arranging the insulators of a given coil section in an offset fashion, each subsection of the given heater coil will be angled relative to the axis of airflow through the duct and arranged so as much of the duct cross section as possible is filled or covered by heating element material to maximize heat transfer to the air stream.

The cutouts 41 and 42 are exemplary of ways in which the insulators can be mounted to the plate 40. Other modes of mounting could be employed if so desired. The important aspect is that a certain number of the insulators that support the resistance wire are offset from other insulators to create the sinusoidal shape of the coil and the advantages discussed above, e.g., noise reduction and minimizing shadowing.

Also, while a plate is employed to support the insulators, other types of supports could also be used. For example, a wire frame could be employed, with clips that hold the insulators as are found in some open coil electrical resistance heater configurations. Also, differently-configured insulators could also be employed with the support and resistance wire coil.

The degree of offset of certain of the insulators can also vary. The degree of offset can be gauged by the distance between the two paths X and Y of FIG. 4. The greater the distance between X and Y, the greater the offset and the higher the amplitude of the sinusoidal shape of the coil. Using an offset distance that is too small approximates the straight line coils of the prior art and the advantages of the invention discussed above are lost. The offset distance can be measured in terms of the resistance wire coil diameter since a smaller resistance wire coil will allow more offset than a larger resistance wire coil, all other things being equal. Thus, a minimum offset guideline can be ½ to 2 times the diameter of the resistance wire coil. Also, while the offset of the cutouts 42 is shown to be the same along the paths X and Y, the offset could vary along the path. Thus, one cutout could be offset more than another cutout so that the sinusoidal shape of the resistance wire coil would not be uniform along the length of the coil.

Figure 5:
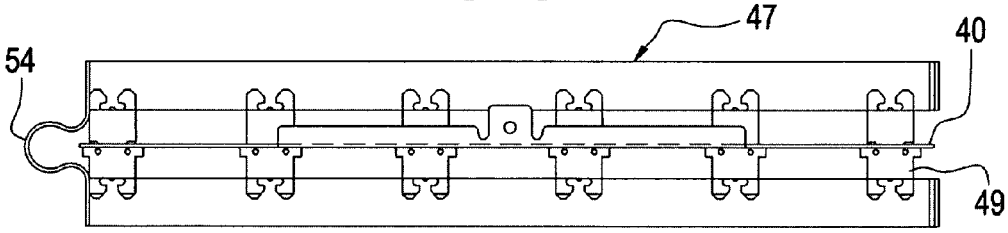
FIG. 5 is side view of the assembly of FIG. 4.
Figure 7:
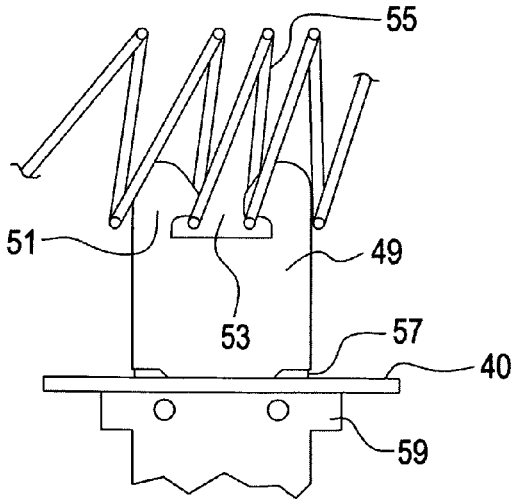
FIG. 7 is a partial and enlarged view of the insulator and plate of the heater of FIG. 4.

While FIGS. 3-7 depict a heater that employs three coils 47 for heating purposes, wherein the cutouts 41 and 42 defining a path for the resistance wire coil 47 are shown in three sets, a single coil could be employed on just one side the plate 40 so that it would start and end on opposite ends of the plate, and only one set of cutouts would be needed. Alternatively, a single coil could be employed that would start on one end of the plate 40, crossover at the other end and terminate at the starting point end. In this latter case, the insulator would be configured to hold the resistance wire coil above and below the plate. If the resistance wire coil is positioned on only one side of the plate, the insulators 49 could be configured to support such one segment of the coil rather than two as shown in FIG. 5.

As such, an invention has been disclosed in terms of preferred embodiments thereof which fulfills each and every one of the objects of the present invention as set forth above and provides a new and improved open coil resistance heater with a specially configured coil and a method of heating using the specially configured coil.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An open coil electrical resistance heater comprising:

a support, at least one resistance wire coil having a longitudinal axis, and a plurality of first insulators mounted to the support along a defined path, with a plurality of second insulators mounted to the support in a position offset from the defined path, each of the first and second insulators configured to provide support to a portion of the resistance wire coil along the defined path, wherein the offset second insulators along with the first insulators on the defined path cause at least a portion of the longitudinal axis of the at least one resistance wire coil to follow a sinusoidal shape, the resistance wire coil with its sinusoidal shape being generally aligned with an air flow path of the heater.

2. The heater of claim 1, wherein the support is a metal plate having a plurality of cutouts, each insulator engaging one of the cutouts for mounting, and a portion of the cutouts are offset from other cutouts on the path to create the offset between the plurality of first and second insulators.

3. The heater of claim 1, wherein the insulators form sets of paths having a sinusoidal shaped resistance wire coil running along each path.

4. The heater of claim 1, wherein the insulators are configured to support a resistance wire coil on each side of the support.

5. The heater of claim 3, wherein the support is a metal plate having a plurality of cutouts, each insulator engaging one of the cutouts for mounting, and a portion of the cutouts are offset from other cutouts on the path to create the offset for the plurality of first and second insulators.

6. The heater of claim 5, wherein the insulators are configured to support the resistance wire coil on each side of the support.

7. The heater of claim 1, further comprising a circular duct surrounding and supporting the support.

8. The heater of claim 2, wherein tension forces created by the sinusoidal shape of the resistance wire coil causes a side portion of each insulator to seat against a side portion of the cutout containing the insulator to dampen vibrations of the insulator against the support.

9. An open coil electrical resistance heater comprising:

a) a duct of defined cross section;

b) a metal plate supported by the circular duct;

c) a plurality of first and second cutouts in the metal plate, the first cutouts aligned along a path coinciding with an air flow path through the circular duct, d) a plurality of insulators, each insulator mounted in one of the first or second cutouts;

e) at least one resistance wire coil supported by the plurality of insulators and adapted to connect to a power source for energizing of the heater, f) wherein the second cutouts and the insulators mounted therein are offset from the first cutouts on the path, the offset creating a sinusoidal shape in at least a portion of the longitudinal axis of the at least one resistance wire coil, the resistance wire coil with its sinusoidal shape being generally aligned with an air flow path of the heater.

10. The heater of claim 9, wherein the metal plate has sets of first and second cutouts and a plurality of resistance wire coils, each set of first and second cutouts supporting one of the resistance wire coils.

11. The heater of claim 9, wherein the duct is circular in cross section.

12. The heater of claim 9, wherein tension forces created by the sinusoidal shape of the resistance wire coil causes a side portion of each insulator to seat against a side portion of the cutout containing the insulator to dampen vibrations of the insulator against the support.

13. A method of reducing vibration and a shadowing effect in open coil electrical resistance heater comprising:

a) providing the open coil electrical resistance heater of claim 1, and b) passing air over the at least one resistance wire coil to heat the air.

* * * * *